US010580090B2

(12) United States Patent
Shah et al.

(10) Patent No.: US 10,580,090 B2
(45) Date of Patent: Mar. 3, 2020

(54) BATCH-COMPUTED ACTIVITY STREAM UPDATES

(71) Applicant: Microsoft Technology Licensing, LLC, Redmond, WA (US)

(72) Inventors: Samir M. Shah, San Francisco, CA (US); Roshan Rajesh Sumbaly, Sunnyvale, CA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 308 days.

(21) Appl. No.: 13/664,846

(22) Filed: Oct. 31, 2012

(65) Prior Publication Data

US 2013/0318036 A1 Nov. 28, 2013

Related U.S. Application Data

(60) Provisional application No. 61/651,994, filed on May 25, 2012.

(51) Int. Cl.
*G06Q 50/00* (2012.01)

(52) U.S. Cl.
CPC ..... *G06Q 50/01* (2013.01)

(58) Field of Classification Search
None
See application file for complete search history.

(56) References Cited

U.S. PATENT DOCUMENTS

2006/0190365 A1 8/2006 Stewart et al.
2009/0171691 A1 7/2009 Lubarski et al.
2009/0216551 A1 8/2009 Chen et al.
2010/0180032 A1 7/2010 Lunt
2010/0318571 A1 12/2010 Pearlman et al.
2011/0119274 A1 5/2011 Clayton et al.
2011/0196932 A1 8/2011 Jackson et al.
2011/0225048 A1 9/2011 Nair
2011/0288939 A1 11/2011 Elvekrog et al.
2011/0314029 A1 12/2011 Fischer et al.
(Continued)

FOREIGN PATENT DOCUMENTS

CN 102365630 A 2/2012
CN 102449658 A 5/2012
(Continued)

OTHER PUBLICATIONS

"European Application Serial No. 13169280.8, Extended European Search Report dated Aug. 9, 2013", 7 pgs.
(Continued)

*Primary Examiner* — Mohsen Almani
(74) *Attorney, Agent, or Firm* — Schwegman Lundberg & Woessner, P.A.

(57) ABSTRACT

A system may receive, at least in part from an update database, a plurality of updates to a plurality of profiles that individually describe ones of a plurality of users of a social network. The system may process, using a batch processor, at least some of the plurality of updates to generate a consolidated update indicative of a status of at least some of the plurality of profiles. The system may transmit the consolidated update to the update database. The system may display the consolidated update on an update stream of the social network corresponding to at least one of the plurality of users.

19 Claims, 6 Drawing Sheets

(56) References Cited

U.S. PATENT DOCUMENTS

| | | | | |
|---|---|---|---|---|
| 2012/0102114 | A1* | 4/2012 | Dunn et al. | 709/204 |
| 2012/0110071 | A1 | 5/2012 | Zhou et al. | |
| 2012/0130813 | A1* | 5/2012 | Hicken et al. | 705/14.54 |
| 2012/0150888 | A1* | 6/2012 | Hyatt et al. | 707/758 |
| 2013/0073546 | A1* | 3/2013 | Yan et al. | 707/732 |

FOREIGN PATENT DOCUMENTS

| | | | |
|---|---|---|---|
| CN | 103646021 | A | 3/2014 |
| DE | 202013005673 | U1 | 10/2013 |
| IN | 1582DEL2013 | A | 2/2015 |
| WO | WO-20120102114 | A1 | 4/2012 |
| WO | WO-2013177439 | A2 | 11/2013 |

OTHER PUBLICATIONS

"International Application Serial No. PCT/US2013/042492, International Preliminary Report on Patentability dated Jun. 23, 2014", 10 pgs.

"International Application Serial No. PCT/US2013/042492, International Search Report dated Dec. 6, 2013", 2 pgs.

"International Application Serial No. PCT/US2013/042492, Written Opinion dated Dec. 6, 2013", 6 pgs.

"Office Action Issued in European Patent Application No. 13169280.8", dated Jan. 23, 2017, 05 pages.

"Summons to Attend Oral Proceedings Issued in European Patent Application No. 13169280.8", dated Feb. 5, 2018, 8 pages.

"First Office Action and Search Report Issued in Chinese Patent Application No. 201310321272.7", dated Sep. 6, 2016, 23 pages.

"Fourth Office Action Issued in Chinese Patent Application No. 201310321272.7", dated Apr. 3, 2018, 23 pages.

"Second Office Action Issued in Chinese Patent Application No. 201310321272.7", dated Apr. 26, 2017, 23 pages.

"Third Office Action Issued in Chinese Patent Application No. 201310321272.7", dated Sep. 30, 2017, 24 pages.

Dhruba, et al., "Apache Hadoop Goes Realtime at Facebook", In Proceedings of the ACM SIGMOD International Conference on Management of Data, Jun. 12, 2011, pp. 1071-1080.

"Office Action Issued in Indian Patent Application No. 1582/DEL/2013", dated Aug. 30, 2019, 5 pages.

* cited by examiner

BATCH-COMPUTED ACTIVITY STREAM UPDATES

CLAIM OF PRIORITY

This application claims the benefit of priority of U.S. Provisional Patent Application No. 61/651,994, titled "BATCH-COMPUTED NEWS FEED UPDATES," which was filed on 25 May, 2012, which is incorporated herein by reference in its entirety.

TECHNICAL FIELD

The subject matter disclosed herein generally relates to techniques for batch-processing information related to various social network interactions for the purpose of generating complex update messages for presentation in a personalized news feed or activity stream.

BACKGROUND

Contemporary network-based social networks can include streaming updates of actions and interactions of the various users of the social network. The actions or status of or relating to one user can be posted automatically as an update to another user. For instance, the update stream can show updates reflecting a change of career of a user or an interaction of the user with another user. As these updates can be posted automatically, other users can be kept appraised of the activities of the user without a need for active involvement in the posting of the updates on the update stream.

BRIEF DESCRIPTION OF THE DRAWINGS

Some embodiments are illustrated by way of example and not limitation in the figures of the accompanying drawings.

DETAILED DESCRIPTION

Figure 1:
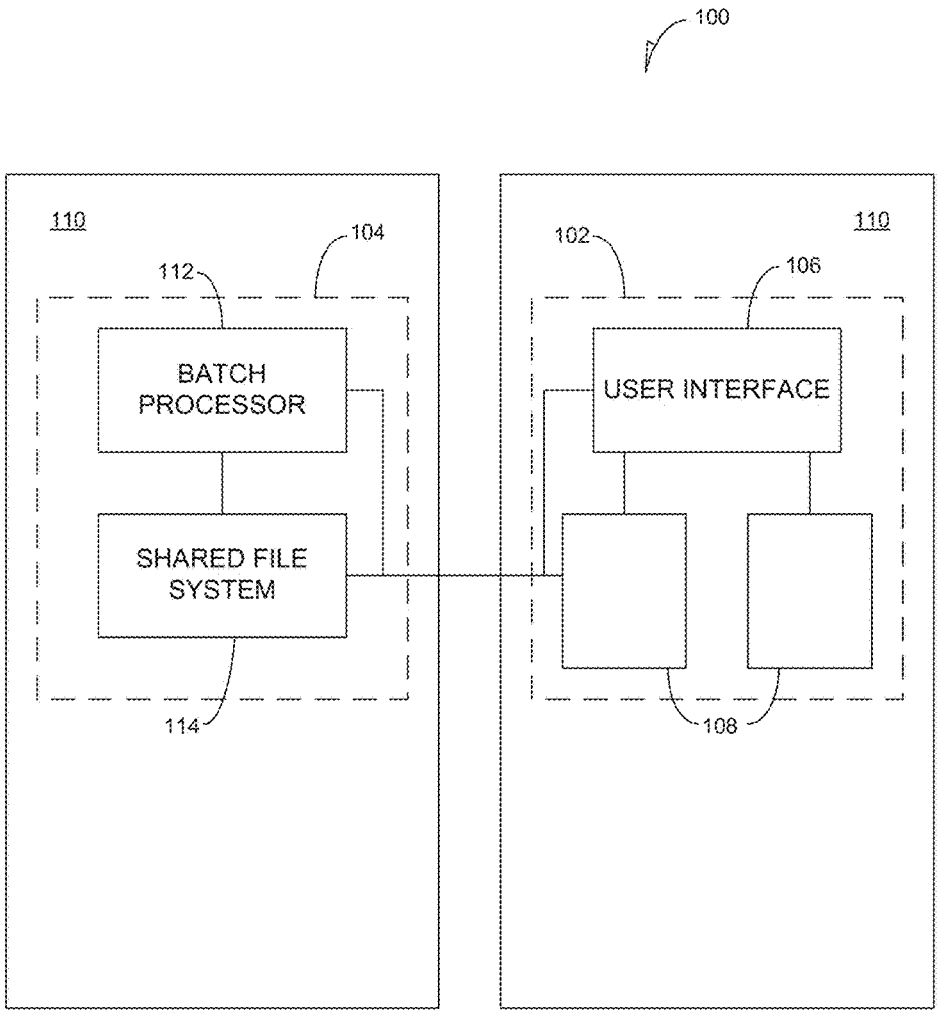
FIG. 1 is a network diagram illustrating a network environment suitable for providing a community notification based on a profile update, according to some example embodiments.

Example methods and systems are directed to provision of a consolidated update. Examples merely typify possible variations. Unless explicitly stated otherwise, components and functions are optional and may be combined or subdivided, and operations may vary in sequence or be combined or subdivided. In the following description, for purposes of explanation, numerous specific details are set forth to provide a thorough understanding of example embodiments. It will be evident to one skilled in the art, however, that the present subject matter may be practiced without these specific details.

Consistent with some embodiments, with proper authorization, certain representatives of an organization can publish messages (referred to herein as "status updates") that are viewable to other members of the social network service via one or more data feeds or content streams. A data feed or content stream consistent with embodiments of the invention may be known to those skilled in the art by a variety of different names, including a "stream," "status update stream," "network update stream," and/or "news feed." Similarly, skilled artisans may refer to this type of message by many different names, including a "status update," "tweet," or simply, and generically, as a message. In any case, when an authorized representative of an organization publishes a status update, the status update may appear in a content stream presented on the web page of the particular organization on whose behalf the status update is being published. Additionally, the status update may appear in a personalized content stream of those members of the social network service who have taken some action to subscribe to receive messages published on behalf of the organization. For example, a member of the social network service may subscribe to receive messages or status updates published on behalf of an organization by simply selecting or otherwise interacting with a graphical user interface element (e.g., a button) presented on a web page in connection with the organization. In various instances, the relationship that a member has with a particular entity or organization as defined in the social graph may automatically result in the member being subscribed to receive information from a particular entity. For example, if a member indicates in his or her member profile that the member is employed with a particular company, attending a particular school, graduated from a particular school, and so forth, this information may be used as the basis for automatically subscribing the member to receive information published on behalf of a particular entity or organization.

Updates posted on update streams of social networking websites can be relatively limited in scope. Contemporary updates may present relatively basic information regarding a user, such as that the user has a new job, has connected with another user, has shared information, likes something, comments on something, and so forth. However, contemporary updates may not present information that pertains to relatively complex interactions between multiple users, activities, relationships, and the like. For instance, contemporary updates, such as may be computationally expensive or complex, may not provide consolidated updates that indicate, for instance, that a particular number of users have changed jobs to a particular company over a certain timeframe, or that a certain number of users have viewed a particular profile.

Such complex updates can be beyond the practical scope of conventional, contemporary processing techniques. Contemporary updates can be the product of standard online-oriented processing, which can be configured to provide relatively simple updates using relatively limited amounts of processing power. Complex updates can be provided by offline processing separated from the resources for providing the webpage itself. Offline resources can be relatively more extensive or capable than online resources and can utilize a batch processor or other batch application. Additionally, the use of offline resources can provide system managers the ability to generate and test new operations and update-generation methods prior to general release. The results of the offline batch processing and offline development can be provided as an update for display in the update stream.

FIG. 1 is a block diagram of a social networking system 100 having an online system 102 and a batch processing system 104. The online system 102 can generally be directed towards collecting information from one or more users and serving a website related to the social network, including such as displaying an update stream corresponding to the one or more users. The batch processing system 104 can be generally directed towards processing information obtained or mined from the online system 102 and providing complex updates to the online system 102 for display on a social networking website. The batch processing system 104 can be an offline system, in that the batch processing system 104 does not necessarily incorporate electronics configured to serve information directly to an outside network, such as the Internet. Alternatively, the batch processing system 104 can be a component of the online system 102 or other system that is configured to interface directly with an outside network.

The online system 102 can include a user interface 106 that can display an interface for a social network with which a user can interact. The user interface 106 can be render webpages, such as can be personalized to individual users of the social network. In an example, the user interface 106 displays a webpage relating to the social network on multiple client devices, such as personal computers, tablet computers, and smartphones. Users of the social network can interact with the social network via the user interface 106, such as by entering information via the user interface 106 as displayed on the electronic device and receiving updates via a update stream as displayed by the user interface 106 on the electronic device.

The user interface 106 can be communicatively coupled to one or more databases 108. The databases 108 can include one or more update databases configured to receive and store the user interactions with the social network and store updates that are derived from the user interactions for subsequent display by the user interface 106, such as consolidated or complex updates as discussed herein. The databases 108 can include or be implemented on electronic storage media, including but not limited to non-volatile computer storage, such as hard disks and flash memory, and volatile computer memory, such as random access memory (RAM).

The online system 102 can be implemented on one or more servers 110 or other networking hardware known in the art. The servers 110 can be communicatively coupled to the Internet and to one another. The batch processing system 104 can be resident on separate servers 110 communicatively coupled to the online system 102, such as via a dedicated network or via the Internet. In an example, while the batch processing system 104 is configured to implement the social network at least partially in conjunction with the online system 102, the batch processing system 104 is not configured to communicate with client devices directly. Consequently, though the batch processing system 104 can communicate with the online system 102, such as via a network or other electronic communication system, the batch processing system 104 can be understood to be an "offline" system.

Operations of the batch processing system 104 are not necessarily pushed to the online system 102 for display on the user interface 106 or otherwise utilized for the conduct of the social network. In an example, the batch processing system 104 can be utilized offline for development of the social network. Such development can include developing and testing new systems and processes that may ultimately be utilized by the system 100. The batch processing system 104 discussed herein can be utilized, such as by system administrators or developers, in substantial isolation from the online system 102.

In an alternative example, the batch processing system 104 can be implemented on the same servers 110 that implement the online system 102. In such an example, the batch processing system 104 can utilize computing resources of the servers 110 that are not utilized by the online system 102. The online system 102 can utilize relatively less-powerful or unsophisticated computing resources while the batch processing system 104 can utilize relatively powerful computing systems to conduct batch processing to generate consolidated updates, such as updates that are relatively complex or computationally intensive relative to more conventional updates as disclosed herein.

The batch processing system 104 can incorporate a batch processor 112 and a shared file system 114. The batch processor 112 can process a set or batch of input data files and produce a set of output data files, and can, in various examples, be based on some or all of the input files considered together. Such processing can be concurrent and may does not necessarily produce a set of output date files in the event that the conditions for producing an output file are not met. Batch processing can stand in contrast to the serial processing of individual files. In an example, the online system 102 utilizes serial processing in contrast to the batch processing of the batch processing system 104.

The shared file system 114 can incorporate information from the online system 102, including, for instance, information relating to activities of various users of the social network. The information stored in the shared file system 114 can be utilized by the batch processor 112 to generate consolidated updates. In an example, the shared file system 114 can additionally store the consolidated updates as generated by the batch processor 112. The consolidated updates can be transmitted to the online system 102 from either the batch processor 112 or from the shared file system 114.

The batch processor 112 can process multiple consolidated updates concurrently or effectively concurrently. The batch processor can be configured to run multiple concurrent processes or "flows," each flow potentially containing one or more chained or sequential "jobs." A job can be understood to be a small or, in certain examples the smallest unit of processing capable of being performed by the batch processor 112, such as a script. In an example, one flow can compute a consolidated update and store the output into the shared file system 114. Additional jobs can be added while other jobs are being processed, making the batch processing of jobs scalable.

In an example, the batch processing system 104 utilizes Apache Hadoop as licensed under the Apache version 2.0 license (Apache and Hadoop are trademarks of the Apache Software Foundation). In an example, the shared file system 114 utilizes the Hadoop Distributed File System (HDFS) as provided by the Apache version 2.0 license. In an example, the batch processor 112 utilizes the Hadoop Pig scripting language. In various examples, alternative distributed computing and file sharing standards, as well as different scripting languages within Hadoop, can be utilized.

A flow for the batch processor can generate consolidated updates for the online system 102. In an example, multiple jobs for the flow can read data off of the shared file system 114, run computations on the data using the batch processor 112, and store the data and/or a consolidated update back to the shared file system 114. In an example, the input data to the batch processor 112 can be present in the shared file system 114 according to an extract, transform, and load (ETL) process known in the art. The transfer of data into the shared file system 114 can be according to regularly scheduled data transfers, based on which the batch processor 112 can create discrete jobs. In various examples, a job does not necessarily produce a consolidated update but rather produces an output that can be utilized by another job. In various examples, some jobs can consequently be subordinate to other jobs.

In an example, one primary flow is configured to generate consolidated updates while all of the other flows are subordinate to the primary flow. The primary flow can include a job for processing the consolidated update to prevent the display of consolidated updates that tend to duplicate information already displayed in other consolidated updates. Additionally, the primary job can transmit or "push" consolidated updates to the online system 102 upon the consolidated updates being completed and, in various examples, deemed not to be duplicative of other consolidated updates. The online system 102 can then display the consolidated update on the user interface 106.

The batch processing system 104 can produce consolidated updates that present relatively complex sets of information relative to what may be presented through serial processing. For instance, while the information transmitted form the online system 102 can generate a simple update, such as "User X connected with user Y", the batch processing system 104 can generate a consolidated update, such as "User X connected with A people from company B". Thus, while a simple update can convey information relating to, for instance, a single or relatively limited event or occurrence in the social network, the consolidated update can convey information relating to multiple events or occurrences in the social network. Additionally, the consolidated updates can display relationships between various occurrences. In an example, if User X has connected with a number of people, the batch processing system 104 can note that a certain company B has a relatively large number of people A with which User X has connected, and thus establish a consolidated update that can include distinctly more information than may be included in a standard update.

Figure 2:
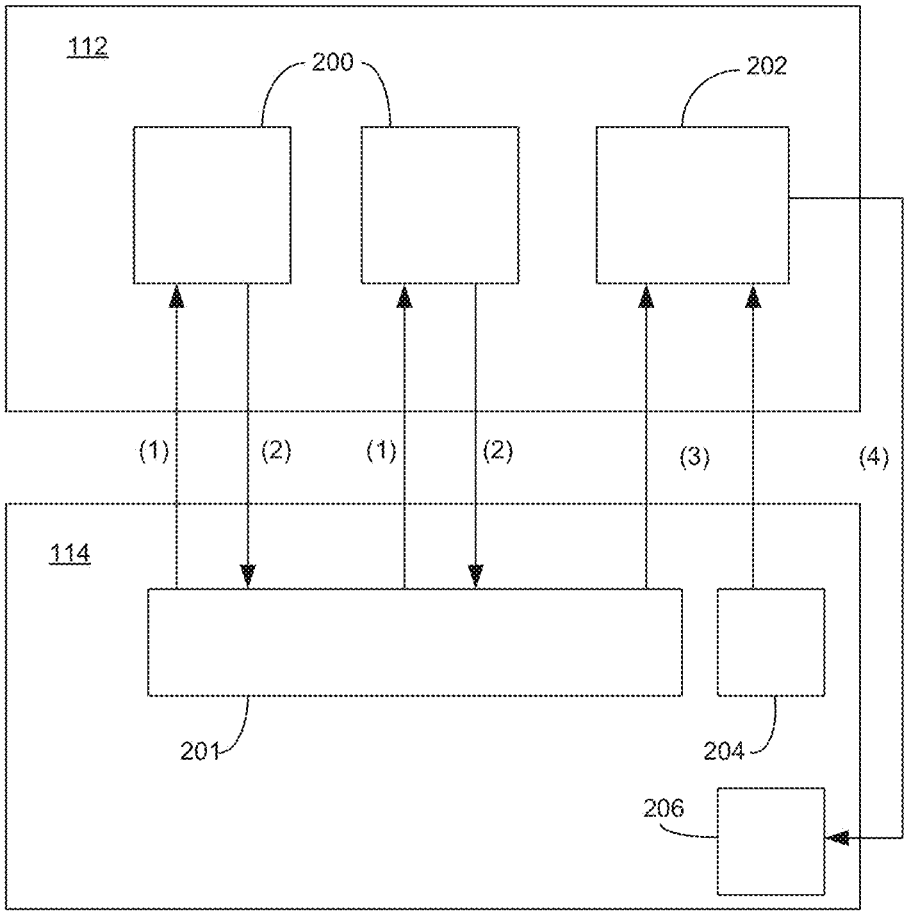
FIG. 2 is a conceptual diagram illustrating users of a social networking service being described by user profiles that indicate groups of users socially connected to the user by a social network, according to some example embodiments.

FIG. 2 is a flow diagram illustrating the generation of a consolidated update. The shared file system 114 can obtain data from the database 108. In flow step (1), the shared file system 114 can distribute various pieces of data to the batch processor 112, which can initiate corresponding, independent jobs 200 to process the data. In an example, the shared file system 114 can distribute the data from electronic storage 201 to the batch processor periodically, such as every four hours. In alternative examples, the shared file system 114 can push data out based on event-driven criteria, such as receipt of the data, rather than via regular time intervals, or the batch processor 112 can request particular data. In an example, the timing conditions for each job 200 can be set independently, whether at regular intervals or based on event-driven criteria.

In flow step (2), the batch processor 112 can transfer updates generated by completed jobs 200 to the shared file system 114. The batch processor 112 can transfer the updates based on a script in the corresponding job commanding the transfer to the shared file system 114. The batch processor 112 can transfer the updates individually upon completion of the corresponding job 200, or can transfer the updates periodically. In an example, the shared file system 114 can store the generated updates in one or both of short term storage and a long term archive.

In flow step (3), the shared file system 114 can optionally transfer some or all of the updates stored in the shared file system 114 to the batch processor for running in the primary job 202 to generate the consolidated update. The consolidated update can be generated based on business rules 204 that are, in an example, also stored on the shared file system 114. Business rules, as discussed herein, can include rules regarding what information is transmitted in consolidated updates and prevention against duplication of information.

The primary flow 202 can operate at a frequency or event-driven timing that is more frequent than that of the flows 200. In an example, where the flows 200 operate on a timeframe of one or more hours, the primary flow 202 can operate on a timeframe of one or more minutes. The primary flow 202 can operate on such a timeframe in order to accommodate the independent operation of the flows 200; because the batch processor 112 may operate hundreds, thousands or more of such flows 200 concurrently, multiple such flows 200 may complete every minute.

In an example, the primary flow 202 can obtain a current assessment or "snapshot" of a state of the shared file system 114. In various examples, the snapshot can relate to consolidated updates written by individual flows 200, can remove duplicative updates, and/or can apply business rules that can, as disclosed herein, include rules regarding what information is to be transmitted to users of the social network in consolidated updates.

In an example, a primary flow 202 ends with a job to transfer the updates from the shared file system 114 to the online system 102 for display on the social network. A short term directory or archive can save updates and other files for a relatively short period of time in comparison with an archive file on the shared file system 114, such as for debugging purposes. The length of time updates are stored in the short term director can be configurable.

In an example, the job to transfer the updates can transfer updates from the shared file system 114 according to a user identification number or other user identifier. In an example, a consolidated update can be generated for a particular user having the user identification number, and can incorporate updates that correspond to user identification numbers that are related to the user who is the direct subject of the consolidated update. In an example, such related users are related according to modes known in social networks, including contacts, friends, relatives, and so forth.

In an example, the job to transfer the update can de-duplicate the updates according to user identification number. To the extent that an update has already been sent to a particular user identification number, the data related to the already-transferred update may, under certain circumstances, not again transmitted to the same user identification number. In an example, de-duplication is done on the basis of a hash of individual tuple values inside of each update.

In an example, as noted above, the job to transfer the update can apply business rules in the generation of the consolidated update. In various examples, the business rules can establish criteria by which consolidated updates are targeted to particular users. In various examples, business rules can target delivery of consolidated updates based on user identification, user location, user age, user employer, user career, and so forth.

In flow step (4), the batch processor 112 can transfer the consolidated update, in various examples to the shared file system 114, such as to an archive file 206, to the online system 102, or both. The transfer of the consolidated update can be on the basis of a job that generates the consolidated update. The consolidated update, as archived, can be utilized in the generation of future consolidated updates.

Figure 3:
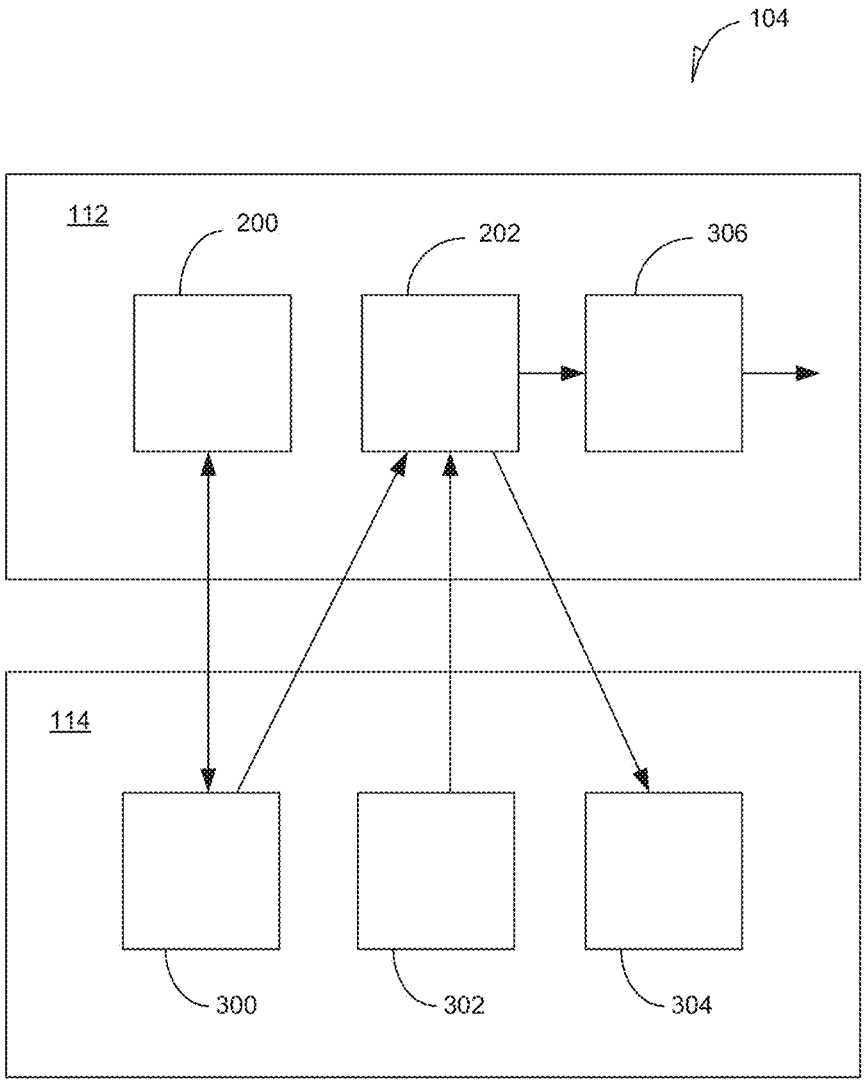
FIG. 3 is a block diagram illustrating user profiles, according to some example embodiments.

FIG. 3 is a block diagram of an example of the batch processing system 104. In the illustrated example, the shared file system 114 may be implemented as three separate Hadoop distributed file systems (HDFS) 300, 302, 304, such as an update HDFS 300, a business rule HDFS 302, and an archive HDFS 304. In various alternative examples, each HDFS is a separate or alternative distributed file system. Each HDFS 300, 302, 304 can operate to store the respective information as discussed above. In such examples, the update HDFS 300 can store updates as generated by the flows 200, the business rule HDFS 302 can store business rules 204, and the archive HDFS 304 can store consolidated updates. In various examples, the update HDFS 300 can additionally store information received from the online system 102. In various examples, the archive HDFS 304 can store updates transmitted from the update HDFS 300 without the updates being utilized to create consolidated updates.

The batch processor 112 can incorporate and run the flows 200 and primary flow 202. In an example, the batch processor 112 can also incorporate a pipeline manager 306 configured to facilitate the transfer of consolidated updates to the online system 102. In an example, the pipeline manager 306 is not physically instantiated but rather is a function of a job as run by the primary flow 202. Alternatively, the pipeline manager 306 is physically instantiated as hardware such as a dedicated processor or custom circuitry separate from the batch processor 112. In various examples, the pipeline manager 306 can manage delivery of information to the online system 102 by other components of the batch processing system 104 or of the system 100 in general.

In an example, the pipeline manager 306 incorporates or is communicatively coupled to a memory module. In such an example, the pipeline manager 306 can store information such as consolidated updates and other data. The pipeline manager 306 can transmit the stored information to the online system 102 at particular times, including periodic transmittals, event-driven transmittals, or both.

Figure 4:
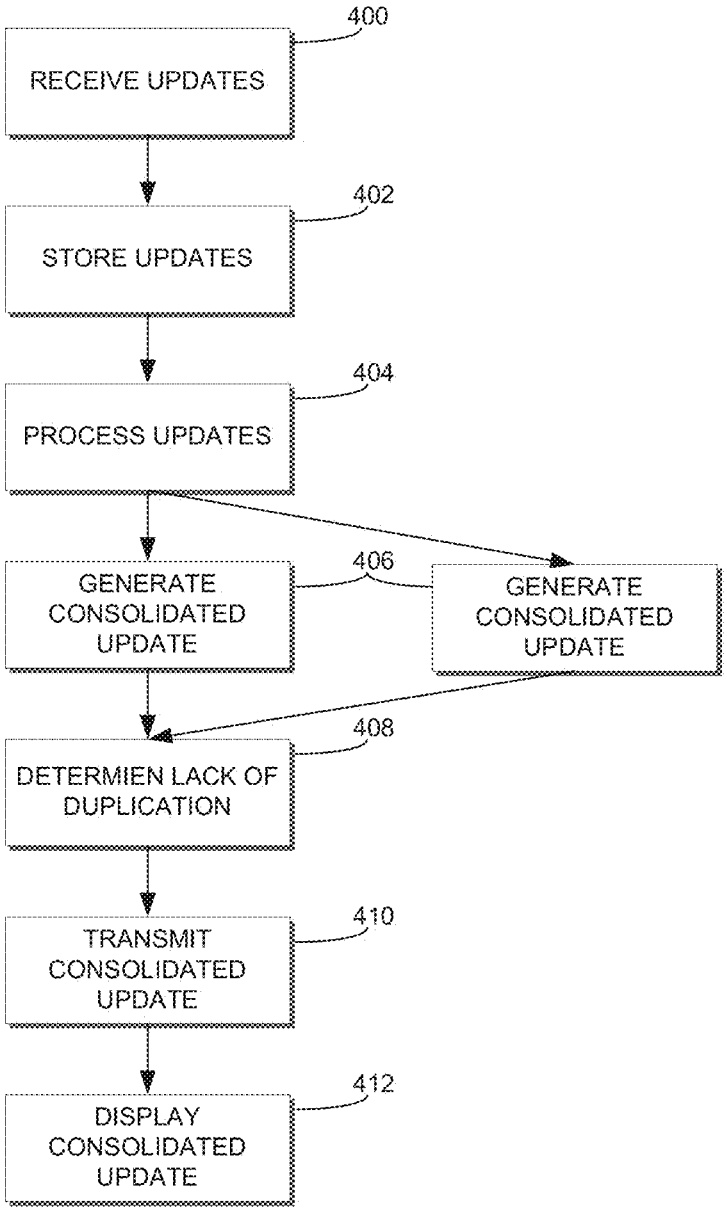
FIG. 4 is a flowchart for generating a consolidated update.

FIG. 4 is a flowchart for generating a consolidated update. The flowchart can utilize the social networking system 100 or any other suitable system or device.

In operation 400, the batch processing system 104 receives a plurality of updates. At least some of the plurality of updates can be received from an update database 108. Individual updates can correspond to a profile of a user of a social network provided, at least in part, by the social networking system 100. The batch processing system 104 can receive at least some of the plurality of updates via the user interface 106, such as via a web-based user interface.

In operation 402, the plurality of updates can be stored in the shared file system 114. The shared file system 114 can be a component of an offline batch processing system 104. Components of the batch processing system 104 can utilize the plurality of updates, such as for the creation of the consolidated update.

In operation 404, the plurality of updates can be processed by the batch processor 112.

In operation 406, the batch processor 112 can generate the consolidated update based on processing the plurality of updates. Multiple instances of operation 406 can be performed concurrently. The various instances can utilize the same plurality of updates or a different plurality of updates for each instance of operation 406. Each instance of operation 406 can generate a different consolidated update.

The consolidated update can be indicative of a change in status of at least some user profiles. The consolidated update can be indicative of a similar status of at least some of the plurality of profiles.

In operation 408, a lack of duplication of the consolidated update with other information already displayed on the user interface 106 can be determined. The lack of duplication can be determined, for instance, by the primary flow 202 and/or by the pipeline manager.

In operation 410, the consolidated update is transmitted, such as to the online system 102. In particular, the consolidated update can be transmitted to the update database 108. Operation 410 can occur in series or parallel with operation 408. The consolidated update can be transmitted, at least in part, by the primary flow 202 and/or the pipeline manager 306.

In operation 412, the consolidated update is displayed on the user interface 106. The user interface 106 can be a web-based user interface. The user interface 106 can include an update stream. The displaying of the consolidated update can be based, at least in part, on a lack of duplication of the consolidated update with other updates in the update stream and a conformity of the consolidated update with a business rule. The business rule can include a restriction on displaying the consolidated update on the update stream based on a personal characteristic of one of the users of the social network.

Figure 5:
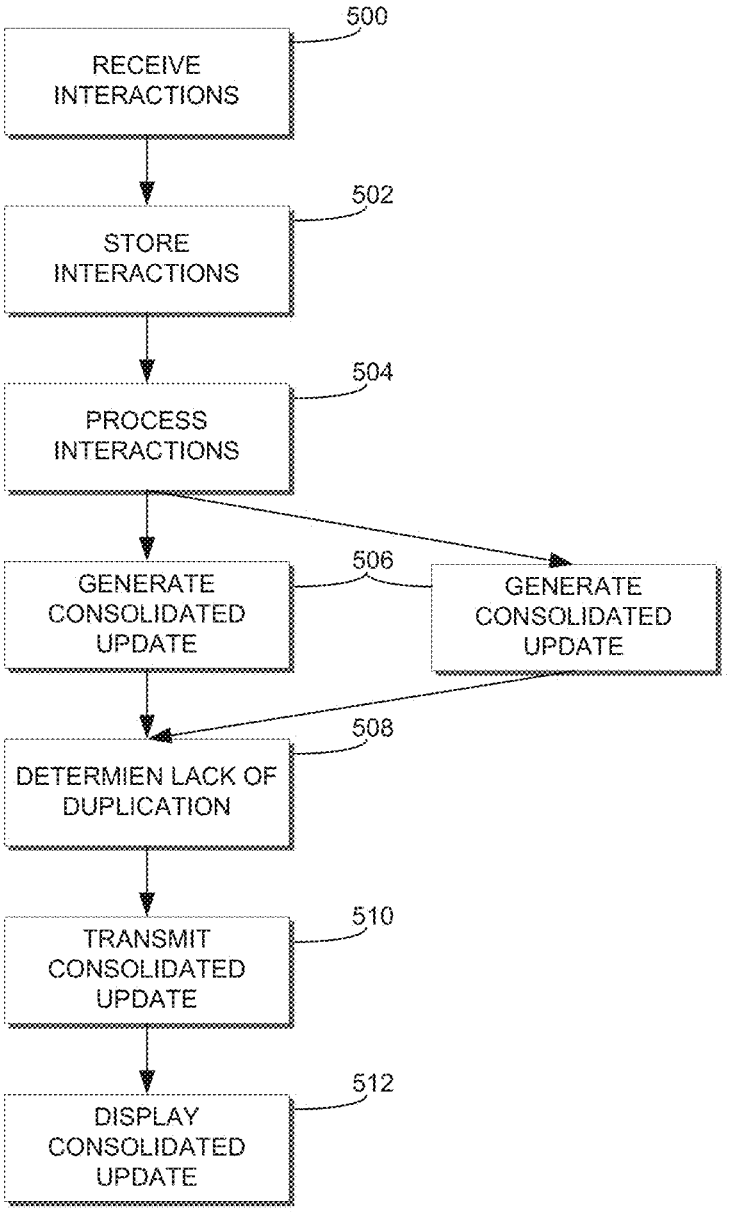
FIG. 5 is a flowchart for generating a consolidated update.

FIG. 5 is a flowchart for generating a consolidated update. The flowchart can utilize the social networking system 100 or any other suitable system or device.

In operation 500, the batch processing system 104 receives a plurality of interactions with a social network. At least some of the plurality of interactions can be received from an update database 108. Individual interactions can correspond to a profile of a user of a social network provided, at least in part, by the social networking system 100. The batch processing system 104 can receive at least some of the plurality of interactions via the user interface 106, such as via a web-based user interface.

The various interactions can include an update to a profile of the social network, a common status of some of the profiles on the social network, an interaction between users of the social network, a reference to a profile, and a view of the profile by a third-party user of the social network. The interactions can include other interactions or activities and do not necessarily include all of the listed interactions.

In operation 502, the plurality of interactions can be stored in the shared file system 114. The shared file system 114 can be a component of an offline batch processing system 104. Components of the batch processing system 104 can utilize the plurality of interactions, such as for the creation of the consolidated update.

In operation 504, the plurality of interactions can be processed by the batch processor 112.

In operation 506, the batch processor 112 can generate the consolidated update based on processing the plurality of interactions. Multiple instances of operation 506 can be performed concurrently. The various instances can utilize the same plurality of interactions or a different plurality of interactions for each instance of operation 506. Each instance of operation 506 can generate a different consolidated update.

The consolidated update can be indicative of a change in status of at least some user profiles. The consolidated update can be indicative of a similar status of at least some of the plurality of profiles.

In operation 508, a lack of duplication of the consolidated update with other information already displayed on the user interface 106 can be determined. The lack of duplication can be determined, for instance, by the primary flow 202 and/or by the pipeline manager.

In operation 510, the consolidated update is transmitted, such as to the online system 102. In particular, the consolidated update can be transmitted to the update database 108. Operation 510 can occur in series or parallel with operation 508. The consolidated update can be transmitted, at least in part, by the primary flow 202 and/or the pipeline manager 306.

In operation 512, the consolidated update is displayed on the user interface 106. The user interface 106 can be a web-based user interface. The user interface 106 can include an update stream. The displaying of the consolidated update can be based, at least in part, on a lack of duplication of the consolidated update with other updates in the update stream and a conformity of the consolidated update with a business rule. The business rule can include a restriction on displaying the consolidated update on the update stream based on a personal characteristic of one of the users of the social network.

Figure 6:
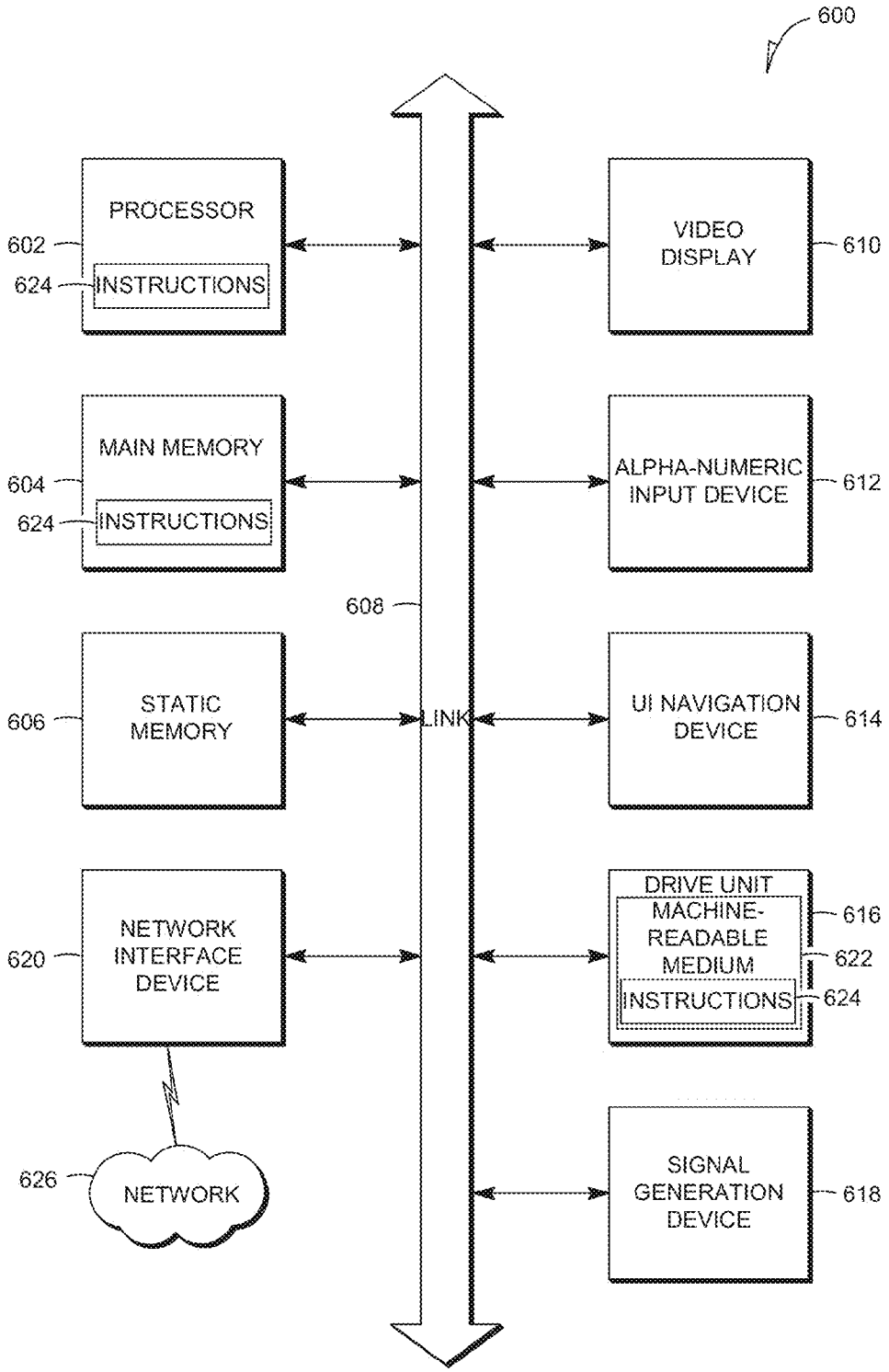
FIG. 6 is a block diagram illustrating components of a machine able to read instructions from a machine-readable medium.

FIG. 6 is a block diagram illustrating components of a machine 600, according to some example embodiments, able to read instructions from a machine-readable medium (e.g., a machine-readable storage medium) and perform any one or more of the methodologies discussed herein. Specifically, FIG. 6 shows a diagrammatic representation of the machine 600 in the example form of a computer system and within which instructions 624 (e.g., software) for causing the machine 600 to perform any one or more of the methodologies discussed herein may be executed. In alternative embodiments, the machine 600 operates as a standalone device or may be connected (e.g., networked) to other machines. In a networked deployment, the machine 600 may operate in the capacity of a server machine or a client machine in a server-client network environment, or as a peer machine in a peer-to-peer (or distributed) network environment. The machine 600 may be a server computer, a client computer, a personal computer (PC), a tablet computer, a laptop computer, a netbook, a set-top box (STB), a personal digital assistant (PDA), a cellular telephone, a smartphone, a web appliance, a network router, a network switch, a network bridge, or any machine capable of executing the instructions 624, sequentially or otherwise, that specify actions to be taken by that machine. Further, while only a single machine is illustrated, the term "machine" shall also be taken to include a collection of machines that individually or jointly execute the instructions 624 to perform any one or more of the methodologies discussed herein.

The machine 600 includes a processor 602 (e.g., a central processing unit (CPU), a graphics processing unit (GPU), a digital signal processor (DSP), an application specific integrated circuit (ASIC), a radio-frequency integrated circuit (RFIC), or any suitable combination thereof), a main memory 604, and a static memory 606, which are configured to communicate with each other via a bus 608. The machine 600 may further include a graphics display 610 (e.g., a plasma display panel (PDP), a light emitting diode (LED) display, a liquid crystal display (LCD), a projector, or a cathode ray tube (CRT)). The machine 600 may also include an alphanumeric input device 612 (e.g., a keyboard), a cursor control device 614 (e.g., a mouse, a touchpad, a trackball, a joystick, a motion sensor, or other pointing instrument), a storage unit 616, a signal generation device 618 (e.g., a speaker), and a network interface device 620.

The storage unit 616 includes a machine-readable medium 622 on which is stored the instructions 624 (e.g., software) embodying any one or more of the methodologies or functions described herein. The instructions 624 may also reside, completely or at least partially, within the main memory 604, within the processor 602 (e.g., within the processor's cache memory), or both, during execution thereof by the machine 600. Accordingly, the main memory 604 and the processor 602 may be considered as machine-readable media. The instructions 624 may be transmitted or received over a network 626 via the network interface device 620.

As used herein, the term "memory" refers to a machine-readable medium able to store data temporarily or permanently and may be taken to include, but not be limited to, random-access memory (RAM), read-only memory (ROM), buffer memory, flash memory, and cache memory. While the machine-readable medium 622 is shown in an example embodiment to be a single medium, the term "machine-readable medium" should be taken to include a single medium or multiple media (e.g., a centralized or distributed database, or associated caches and servers) able to store instructions. The term "machine-readable medium" shall also be taken to include any medium, or combination of multiple media, that is capable of storing instructions (e.g., software) for execution by a machine (e.g., machine 600), such that the instructions, when executed by one or more processors of the machine (e.g., processor 602), cause the machine to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" shall accordingly be taken to include, but not be limited to, one or more data repositories in the form of a solid-state memory, an optical medium, a magnetic medium, or any suitable combination thereof.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms. Modules may constitute either software modules (e.g., code embodied on a machine-readable medium or in a transmission signal) or hardware modules. A "hardware module" is a tangible unit capable of performing certain operations and may be configured or arranged in a certain physical manner. In various example embodiments, one or more computer systems (e.g., a standalone computer system, a client computer system, or a server computer system) or one or more hardware modules of a computer system (e.g., a processor or a group of processors) may be configured by software (e.g., an application or application portion) as a hardware module that operates to perform certain operations as described herein.

In some embodiments, a hardware module may be implemented mechanically, electronically, or any suitable combination thereof. For example, a hardware module may include dedicated circuitry or logic that is permanently configured to perform certain operations. For example, a hardware module may be a special-purpose processor, such as a field programmable gate array (FPGA) or an ASIC. A hardware module may also include programmable logic or circuitry that is temporarily configured by software to perform certain operations. For example, a hardware module may include software encompassed within a general-purpose processor or other programmable processor. It will be appreciated that the decision to implement a hardware module mechanically, in dedicated and permanently configured circuitry, or in temporarily configured circuitry (e.g., configured by software) may be driven by cost and time considerations.

Accordingly, the phrase "hardware module" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented module" refers to a hardware module. Considering embodiments in which hardware modules are temporarily configured (e.g., programmed), each of the hardware modules need not be configured or instantiated at any one instance in time. For example, where a hardware module comprises a general-purpose processor configured by software to become a special-purpose processor, the general-purpose processor may be configured as respectively different special-purpose processors (e.g., comprising different hardware modules) at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple hardware modules exist contemporaneously, communications may be achieved through signal transmission (e.g., over appropriate circuits and buses) between or among two or more of the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module implemented using one or more processors.

Similarly, the methods described herein may be at least partially processor-implemented, a processor being an example of hardware. For example, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an application program interface (API)).

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Some portions of this specification are presented in terms of algorithms or symbolic representations of operations on data stored as bits or binary digital signals within a machine memory (e.g., a computer memory). These algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or any suitable combination thereof), registers, or other machine components that receive, store, transmit, or display information. Furthermore, unless specifically stated otherwise, the terms "a" or "an" are herein used, as is common in patent documents, to include one or more than one instance. Finally, as used herein, the conjunction "or" refers to a non-exclusive "or," unless specifically stated otherwise.

What is claimed is:

1. A memory device, the memory device communicatively coupled to a processor and comprising instructions which, when performed on the processor, cause the processor to:

receive, from an electronic storage, data related to a social network; generate, using a batch processor, a plurality of updates based, at least in part, on the data, a first one of the plurality of updates generated based on a first processing job and a second one of the plurality of updates generated based on a second processing job different than the first processing job, the plurality of updates individually describing ones of a plurality of users of the social network;

store the plurality of updates in an update database; receive, at least in part from the update database, the plurality of updates; process, using the batch processor, at least two of the plurality of updates to generate a consolidated update indicative of data obtained from each of the at least two of the plurality of updates;

transmit the consolidated update to the update database; and display the consolidated update and one of the plurality of updates not used to generate the consolidated update on an update stream of the social network corresponding to at least one of the plurality of users.

2. The memory device of claim 1, wherein the consolidated update is indicative of a change in status of data obtained from each of the at least two of the plurality of updates.

3. The memory device of claim 1, wherein the consolidated update is indicative of a similar status of data obtained from each of the at least two of the plurality of updates.

4. The memory device of claim 1, wherein the batch processor is configured to concurrently generate a plurality of consolidated updates, each of the plurality of consolidated updates based on at least two of the plurality of updates.

5. The memory device of claim 1, wherein the plurality of updates are received via a web-based user interface, wherein the consolidated update is displayed on the web-based user interface, and wherein the batch processor is a component of an offline system.

6. The memory device of claim 5, wherein the web-based user interface and the update database are components of an online system communicatively coupled to the offline system, and wherein the memory device further comprises instructions to cause the processor to:

store the plurality of updates in a file system of the offline system, wherein the batch processor processes the at least two of the plurality of updates from the file system of the offline system.

7. The memory device of claim 6, wherein the memory device further comprises instructions to cause the processor to:

display the consolidated update on an update stream of the social network based, at least in part, on:

a lack of duplication of the consolidated update with other updates in the update stream; and a conformity of the consolidated update with a business rule.

8. The memory device of claim 7, wherein the memory device further comprises instructions to cause the processor to:

determine the lack of duplication of the consolidated update based, at least in part, on a characteristic of the consolidated update in comparison with a characteristic of the update stream corresponding to the at least one of the plurality of users of the social network.

9. The memory device of claim 7, wherein the business rule comprises a restriction on displaying the consolidated update on the update stream based on a personal characteristic of the at least one of the plurality of users of the social network.

10. A memory device, the memory device communicatively coupled to a processor and comprising instructions which, when performed on the processor, cause the processor to:

receive, from an electronic storage, data related to interactions with a social network;

generate, using a batch processor, a plurality of updates based, at least in part, on the data, a first one of the plurality of updates generated based on a first processing job and a second one of the plurality of updates generated based on a second processing job different than the first processing job, the plurality of updates individually describing ones of a plurality of users of the social network;

wherein the hatch processor is configured to concurrently generate a plurality of consolidated updates, each of the plurality of consolidated updates based on at least two of the plurality of updates;

store the plurality of updates in an update database;

receive, from the update database, the plurality of interactions with a social network; process, using a batch processor, at least two of the plurality of interactions to generate a consolidated update indicative of interactions with at least two of a plurality of updates of the social network;

cause the display of the consolidated update and one of the plurality of updates not used to generate the consolidated update on an update stream of the social network.

11. A system comprising;

a hardware-implemented data receiver module configured to receive, from an electronic storage, data related to a social network;

a batch processor configured to generate a plurality of updates based, at least in part, on the data, a first one of the plurality of updates generated based on a first processing job and a second one of the plurality of updates generated based on a second processing job different than the first processing job, the plurality of updates individually describing ones of a plurality of users of the social network;

a hardware-implemented storage module configured to store the plurality of updates in an update database;

a hardware-implemented update receiver module configured to receive the plurality of updates;

wherein the batch processor configured to process at least two of the plurality of updates to generate a consolidated update indicative of data obtained from each of the at least two of the plurality of updates;

a hardware-implemented display module configured to cause the consolidated update and one of the plurality of updates not used to generate the consolidated update to be displayed on an update stream of the social network corresponding to at least one of the plurality of users.

12. The system of claim 11, wherein the consolidated update is indicative of a change in status of the data obtained from each of the at least two of the plurality of updates.

13. The system of claim 11, wherein the consolidated update is indicative of a similar status of the data obtained from each of the at least two of the plurality of updates.

14. The system of claim 11, wherein the batch processor is configured to concurrently generate a plurality of consolidated updates, each of the plurality of consolidated updates based on at least two of the plurality of updates.

15. The system of claim 11, further comprising:

a web-based user interface configured to receive the plurality of updates and display the consolidated update; and an offline system comprising the hatch processor.

16. The system of claim 15, further comprising an online system comprising the web-based user interface and the update database, the online system being communicatively coupled to the offline system, and wherein the offline system further comprises a file system configured to store the plurality of updates, wherein the batch processor processes the at least two of the plurality of updates from the file system.

17. The system of claim 16, wherein the batch processor is further configured to cause the display module to display the consolidated update on an update stream of the social network based, at least in part, on:

a lack of duplication of the consolidated update with other updates in the update stream; and a conformity of the consolidated update with a business rule.

18. The system of claim 17, wherein the batch processor is further configured to determine the lack of duplication of the consolidated update based, at least in part, on a characteristic of the consolidated update in comparison with a characteristic of the update stream corresponding to the at least one of the plurality of users of the social network.

19. The system of claim 17, wherein the business rule comprises a restriction on displaying the consolidated update on the update stream based on a personal characteristic of the at least one of the plurality of users of the social network.

* * * * *